United States Patent [19]

Seidel

[11] 4,096,650

[45] Jun. 27, 1978

[54] FOOTWEAR

[75] Inventor: Sigurd Seidel, Graz, Austria

[73] Assignee: Skischuhfabrik Dynafit Gesellschaft m.b.H., Graz, Austria

[21] Appl. No.: 742,060

[22] Filed: Nov. 15, 1976

[51] Int. Cl.[2] ..... A43B 5/04; A43B 1/10

[52] U.S. Cl. ..... 36/120; 36/7.3

[58] Field of Search ..... 36/117, 118, 119, 120, 36/121, 7.1, 7.3, 4, 142 E, 142 EV

[56] References Cited

U.S. PATENT DOCUMENTS

| | | | |
|---|---|---|---|
| 3,319,360 | 5/1967 | Nadler | 36/7.3 |
| 3,721,023 | 3/1973 | Kastinger | 36/120 |
| 3,922,800 | 12/1975 | Miller et al. | 36/117 |

*Primary Examiner*—Patrick D. Lawson

*Attorney, Agent, or Firm*—Fleit & Jacobson

[57] ABSTRACT

The footwear comprises a liner, which is provided with a marking, and an outer layer, which covers the liner and consists of at least partly transparent plastics material. An inner layer may be provided, if desired. The outer layer constitutes a shell, which includes the sole.

1 Claim, 1 Drawing Figure

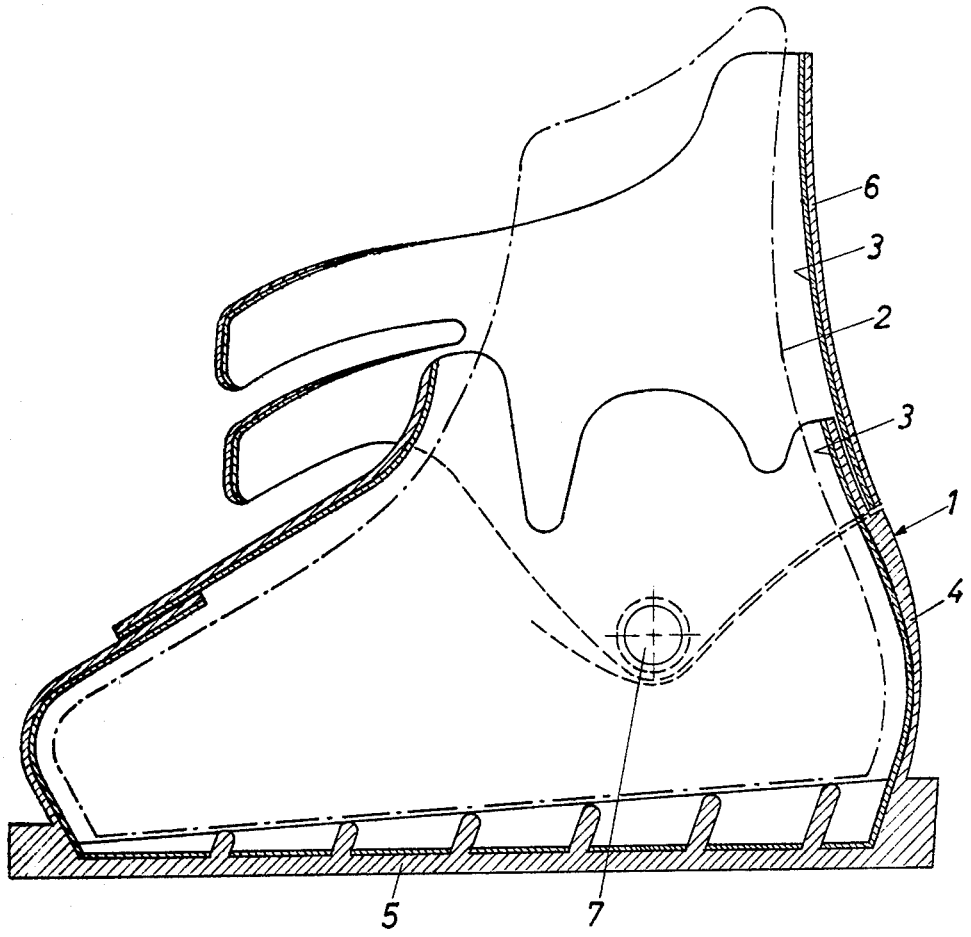
6
3
2
3
1
4
5
7

FOOTWEAR

SUMMARY OF THE INVENTION

Footwear comprises a transparent shell of plastics material. The transparent shell includes the sole and upper of the shoe and is provided on the inside with a liner, which has a pattern that is visible from the outside of the shoe.

Known shoes comprise an upper, which is composed of a plurality of layers. The outer layer consists of plastics material and is at least in part transparent. The underlying layer is provided with an imprint. This upper is embraced by an upturned rim of a sole layer and is bonded to the latter. That design can be used only for light, flat shoes for use indoors or in the summer.

It is an object of the invention to provide footwear which may be used as sports shoes and particularly as skiing boots and can be designed to have a conspicuous appearance and be provided with script characters and pictorial symbols.

Such characters or symbols may be used on the outside surface of skiing boots to identify the manufacturer or supplier of the boots. It is an object of the invention to provide footwear in which such characters or symbols are durable and do not disappear as the outside surface of the shoe is worn off. Another object of the invention is to enable during the manufacture of the shoes the provision of various identification marks which have been requested by customers and are visible from the outside.

These objects are accomplished in that the outer layer of the shoe constitutes a shell, which consists of transparent plastics material and comprises the sole and upper of the shoe, and a liner provided with a marking is disposed on the inside of the shell. The term "marking" is to be understood in its widest sense and includes a simple pattern which is provided on a fabric and determines the appearance of the shoe, or a plain colored fabric, which imparts a uniform color, e.g., green, blue, or red, to the shoe, or manufacturers' trademarks, which are then visible from the outside.

Sports shoes of this kind can easily be manufactured and are absolutely tight against an ingress of moisture and dust without need for additional measures and can be provided with pictorial symbols, script characters, and patterns, which are visible through the outside surface of the shoe. The outer layer may be manufactured by a simple injection molding operation.

The liner consists preferably of a tear-resisting textile fabric, which resists also elevated temperatures up to about 150° and substantially resists the penetration of the molten plastics material during the molding operation.

Further details of the invention will be explained more fully with reference to the drawing, which is a longitudinal sectional view showing a skiing boot as an illustrative embodiment of footwear according to the invention.

In a simplified form, the skiing boot shown by way of example comprises an outer shoe 1, an inner shoe 2, and a liner 3, which is disposed between the outer and inner shoes 1 and 2. The outer shoe 1 comprises an upper 4 and a sole 5, which have been made by injection molding or compression molding to form an integral shell of plastics material, which is relatively stiff and transparent or at least translucent. The outer shoe 1 is provided with a gaiter 6, which consists of the same material as the shell and is hinged to the upper 4 by laterally disposed eyelets 7. It is preferable to use a colorless plastics material known under the tradename "Surlyn".

The liners provided in the upper 4 and the gaiter 6 may consist of any material which can be provided with a pattern or another marking, e.g., woven or knitted textile fabric, leather, metal foil or plastics material sheeting. A sock made from the above-mentioned material by sewing, welding or the like operations and provided with the desired pattern, trademark or the like may be fitted on a last, which consists, e.g., of aluminum. In a closed mold the shell consisting of the upper 4 and sole 5 of the outer shoe is then formed on said sock from the above-mentioned plastics material in known manner by compression molding or injection molding.

As has been described hereinbefore, the liner material must resist tearing and elevated temperatures because the injection molding is preferably performed at a pressure of about 1000 bars and a temperature up to 150° C. Owing to the elevated pressure and elevated temperature the liner is firmly bonded to the plastics material, particularly when the liner consists of textile material or leather. When the plastics material has solidified after about 3 minutes, the shell consisting of transparent plastics material and provided on the inside with a fixed liner is removed from the mold.

The inner shoe 2 is inserted into or formed in the above-mentioned shell, which comprises the upper 4 and contains the liner 3. The inner shoe may be made in any desired manner. The liner 3 ensures that the coefficient of friction between the inner shoe and the shell is much higher than between inner shoes and the known unlined outer shoes of opaque plastics material. As a result, the liner provided in accordance with the invention ensures also a good fit of the inner shoe in the shell. The gaiter is made separately of the shell also from transparent plastics material and is also provided on the inside with a liner. As has been mentioned hereinbefore, the gaiter is hinged to the shell.

Any desired appearance can be imparted to the shoe by the selection of a liner having a suitable pattern. One and the same mold can be used for an economical manufacture of shoes having different predetermined appurtenances in any desired manner.

For private brands and cooperation models the invention affords the advantage that the shoes can be individually designed independently of the manufacturer.

It will be understood that a shell which consists of transparent plastics material and is provided on the inside with a patterned liner may be used within the scope of the invention also without an inner shoe and in that case may be provided, if desired, with an inner layer which ensures a good fit of the foot, and that the invention is applicable with good results not only to skiing boots, although the invention is mainly contemplated for the same, but also to other kinds of shoes, such as mountaineering boots, skating boots, etc.

What is claimed is:

1. A ski boot comprising: an outer shoe having an integral shell formed of at least partially transparent plastics material and having an upper portion and a sole portion; a gaiter formed of at least partially transparent plastics material and hingedly connected to and partially overlapping a portion of the outer surface of said upper portion of said outer shoe; a first lining comprised of a textile fabric which resists tearing and temperatures up to about 150° C and substantially resists penetration of the plastics material when the same is in a molten state, said first lining being firmly bonded to the inner surface of said outer shoe during the molding of the outer shoe; a second lining comprised of a textile fabric which resists tearing and temperatures up to about 150° C and substantially resists penetration of the plastics material when the same is in a molten state, said second lining being firmly bonded to the inner surface of said gaiter during the molding of said gaiter; and an inner shoe inserted into said outer shoe, the inner shoe being at least partially held in said outer shoe by the coefficient of friction between said inner shoe and said lining, the coefficient of friction being greater between said inner shoe and said first lining than between said inner shoe and said outer shoe thereby insuring a good fit of said inner shoe in said outer shoe.

* * * * *